US005159348A

United States Patent [19]

Dietl et al.

[11] Patent Number: 5,159,348

[45] Date of Patent: Oct. 27, 1992

[54] INK JET PRINTING APPARATUS

[75] Inventors: Steven J. Dietl; David G. Anderson, both of Ontario; Thomas N. Taylor, Rochester; Michael Carlotta, Sodus; Richard A. Morano, Lyons, all of N.Y.

[73] Assignee: Xerox Corporation, Stamford, Conn.

[21] Appl. No.: 604,319

[22] Filed: Oct. 29, 1990

[51] Int. Cl.[5] ..... B41J 2/175; B41J 2/19

[52] U.S. Cl. ..... 346/1.1; 346/140 R

[58] Field of Search ..... 346/1.1, 75, 140 R

[56] References Cited

U.S. PATENT DOCUMENTS

| | | | |
|---|---|---|---|
| 3,761,953 | 9/1973 | Helgeson et al. | 346/75 |
| 4,318,114 | 3/1982 | Huliba | 346/140 R |
| 4,325,072 | 4/1982 | Rösel | 346/140 R |
| 4,346,388 | 8/1982 | Wiley | 346/75 |
| 4,356,499 | 10/1982 | Kodama | 346/75 |
| 4,359,744 | 11/1982 | Salmre | 346/1.1 |
| 4,380,770 | 4/1983 | Maruyama | 346/140 R |
| 4,383,263 | 5/1983 | Ozawa et al. | 346/140 R |
| 4,462,037 | 7/1984 | Bangs et al. | 346/140 R |
| 4,575,738 | 3/1986 | Sheufelt et al. | 346/140 R |
| 4,607,261 | 8/1986 | McCann et al. | 346/75 |
| 4,614,948 | 9/1986 | Katerberg et al. | 346/75 |
| 4,631,556 | 12/1986 | Watanabe et al. | 346/140 R |
| 4,679,059 | 7/1987 | Dagna | 346/140 R |
| 4,734,719 | 3/1988 | Suzuki | 346/140 R |
| 4,853,717 | 8/1989 | Harmon et al. | 346/140 R |
| 4,929,963 | 5/1990 | Balazar | 346/1.1 |

OTHER PUBLICATIONS

Alt, R. C.; "Air Bubble Expelling from an Ink Jet Printing Head", IBM TDB, vol. 21, No. 6, Nov. 1978, p. 2511.

*Primary Examiner*—Benjamin R. Fuller
*Assistant Examiner*—Alrick Bobb
*Attorney, Agent, or Firm*—Robert A. Chittum

[57] ABSTRACT

In an ink jet printer, a printhead assembly comprising a printhead and an ink reservoir is mounted on a scanning carriage for movement across a recording medium. During printing, droplets of ink are expelled from ink channels within the printhead and the channels are replenished with ink which is drawn in from the reservoir. The reservoir is connected by supply and return lines to an ink source, and a pump is provided to deliver ink from the source along the supply line to prime the printhead and reservoir. To ensure that the reservoir is filled with ink during the priming operation, the outlet from the reservoir to the return line incorporates a flow restriction equal to, or greater than, that of the printhead.

18 Claims, 3 Drawing Sheets

INK JET PRINTING APPARATUS

BACKGROUND OF THE INVENTION

The present invention relates to ink jet printing apparatus and is concerned, more particularly, with the priming of the printhead(s) in such apparatus.

An ink jet printer may be of the "continuous stream" or the "drop-on-demand" type. In the continuous stream type of printer, ink is emitted continuously from one or more orifices in a printhead, producing droplets which are deflected as necessary so that they are deposited either in a specific location on a recording member or, if not required for printing, in a gutter from where they are recirculated Examples of the continuous stream type of printer are described in U.S. Pat. Nos. 3,761,953; 4,346,388; 4,607,261; and 4,614,948. In the drop-on-demand type of printer, ink is contained in a plurality of channels in a printhead and energy pulses are used to cause the droplets of ink to be expelled, as required, from orifices at the ends of the channels and directed towards a recording member.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then refilled by capillary action, which in turn draws ink from a supply container.

It is usually necessary to prime a printhead of an ink jet printer before use, to remove air and ensure that the printhead is full of ink. Priming may, for example, be carried out by applying suction to the ink ejecting orifice(s) to draw ink into the printhead. Alternatively, ink can be forced into the printhead under pressure.

U.S. Pat. No. 4,734,719 describes an ink jet printer in which a capping device is provided to apply suction to the printhead orifices to recover the discharge function of the printhead after a period of non-use. In that printer, the ink channels within the printhead communicate with, and receive ink from, a sub-tank which in turn is supplied with ink from a remote main tank. Air collects in the sub-tank and is removed by applying suction to the sub-tank before suction is applied to the printhead orifices. Suction is applied to the sub-tank via a plurality of suction tubes provided specifically for that purpose. Another printer in which the printhead is primed by applying suction to the printhead orifices is described in U.S. Pat. No. 4,853,717. In that printer, the printhead is part of a cartridge which also contains a reservoir of ink.

U.S. Pat. No. 4,575,738 describes an ink jet printer in which pressurized air is used to deliver ink from a remote supply to the printhead via an ink chamber which forms part of the printhead module. Any entrained air in the ink is separated out and trapped in the ink chamber. To remove the trapped air, a purging vent in the chamber is opened and the air is then forced out through the vent by delivering ink to the chamber. Another arrangement for removing air from the ink chamber of a printhead while printing is in progress is described in U.S. Pat. No. 4,679,059.

U.S. Pat. No. 4,929,963 refers to the possibility of priming a printhead by raising the ink pressure at the printhead above atmospheric pressure, thereby causing the continuous ejection of ink from the printhead together with any air bubbles that may be present.

U.S. Pat. No. 4,325,072 discloses an apparatus for controlling the supply of ink to a writing device comprising a supply container, a source of compressed air, and a first valve in a conduit between the compressed air source and supply container. A second valve is provided in a conduit between the supply container and the writing device for preventing droplet formation by the writing device depending on the pressure of the ink at the writing device.

The present invention relates to an ink jet printer of the type in which the printhead has an associated ink reservoir through which ink is supplied to the printhead from a remote supply tank and in which air collects, for example by separating out from the ink before the ink enters the printhead. An example of that type of printer is described in U.S. Pat. No. 4,462,037.

SUMMARY OF THE INVENTION

It is an object of the invention to facilitate the priming of the printhead and its associated reservoir.

The present invention provides a printhead assembly for an ink jet printer, comprising an ink reservoir and a printhead, wherein the printhead has at least one ink channel that communicates with the reservoir, an ink ejecting orifice at one end of the channel and means operable to cause droplets of ink to be expelled from the orifice for depositing on a recording medium; an ink source; an ink supply line from the source to the said ink reservoir, and an outlet for air and excess ink from the reservoir; wherein means is provided to deliver ink along the supply line from the source to the ink reservoir to prime the assembly, and the said outlet presents a restriction to ink flow equal to, or greater than, that presented by the printhead.

There may be an ink return line from the said outlet to the ink source, in which case, the said restriction may be provided in the outlet or may be the flow resistance of the return line or a combination of the two.

In a printer incorporating the printhead assembly of the invention, the printhead assembly (comprising the ink reservoir and the printhead) may be mounted on a scanning carriage for movement backwards and forwards across the recording medium.

By way of example, embodiments of the invention will be described with reference to the accompanying drawings, wherein like parts have the same index numerals.

DESCRIPTION OF THE PREFERRED EMBODIMENT

Figure 1:
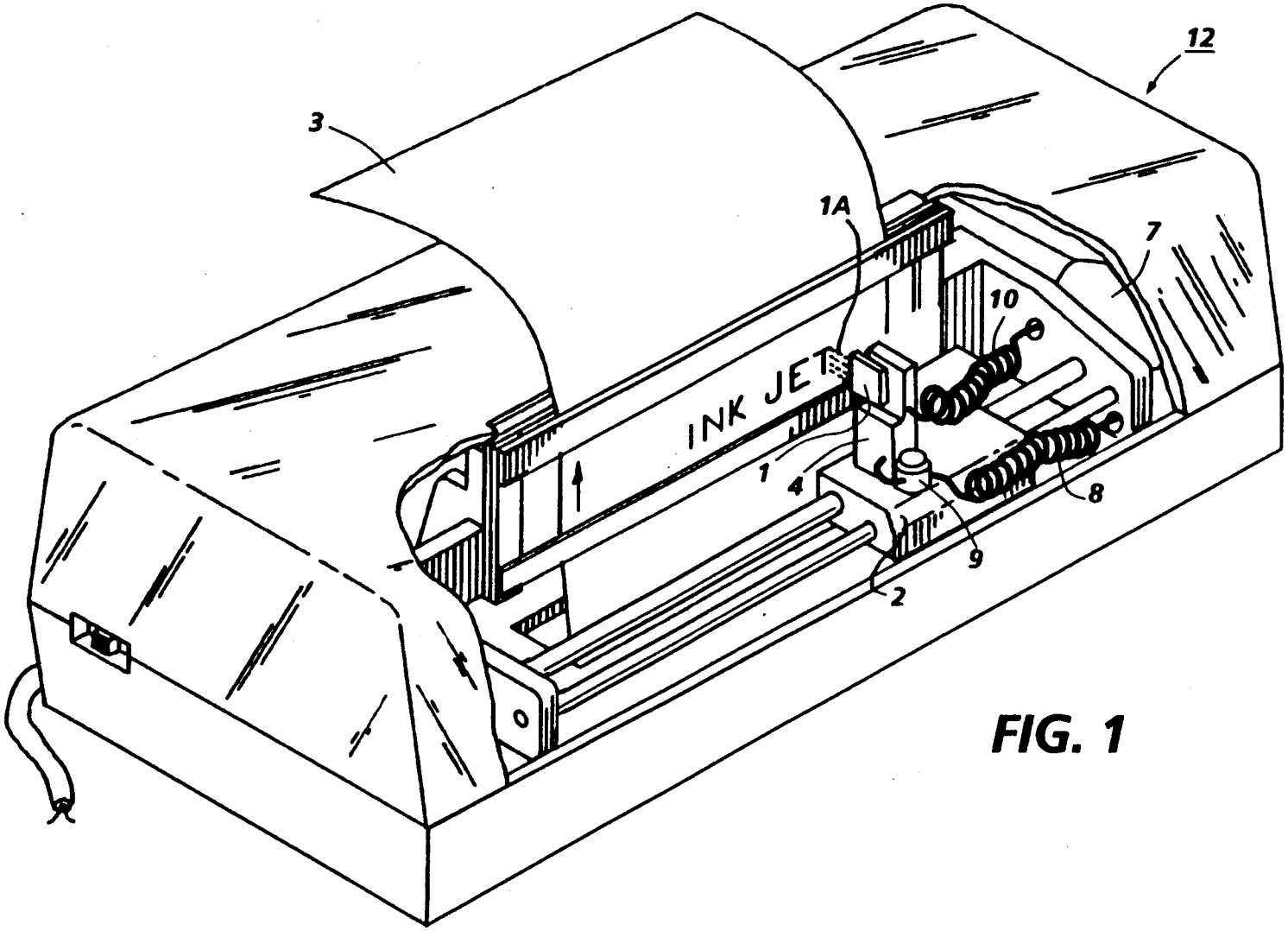
FIG. 1 is a general view of a thermal ink jet printer.

In FIG. 1 of the drawings, the printhead of the thermal ink jet printer 12 is indicated at 1. The printhead is conventional and contains a plurality of ink channels (not visible) each of which has an ink ejecting orifice (also not visible) at one end. The printhead is mounted on a reciprocable carriage 2 which, during a printing operation, carries the printhead backwards and forwards across a recording medium 3. As the printhead is being moved, droplets of ink 1A are directed at the recording medium from the appropriate channel orifices as already described to produce the required printed information. Mounted adjacent the printhead on one side is an on-board ink reservoir 4 from which ink is drawn into the printhead channels via a sealed passageway 13 between the reservoir and printhead to replace that expelled during printing.

Figure 2:
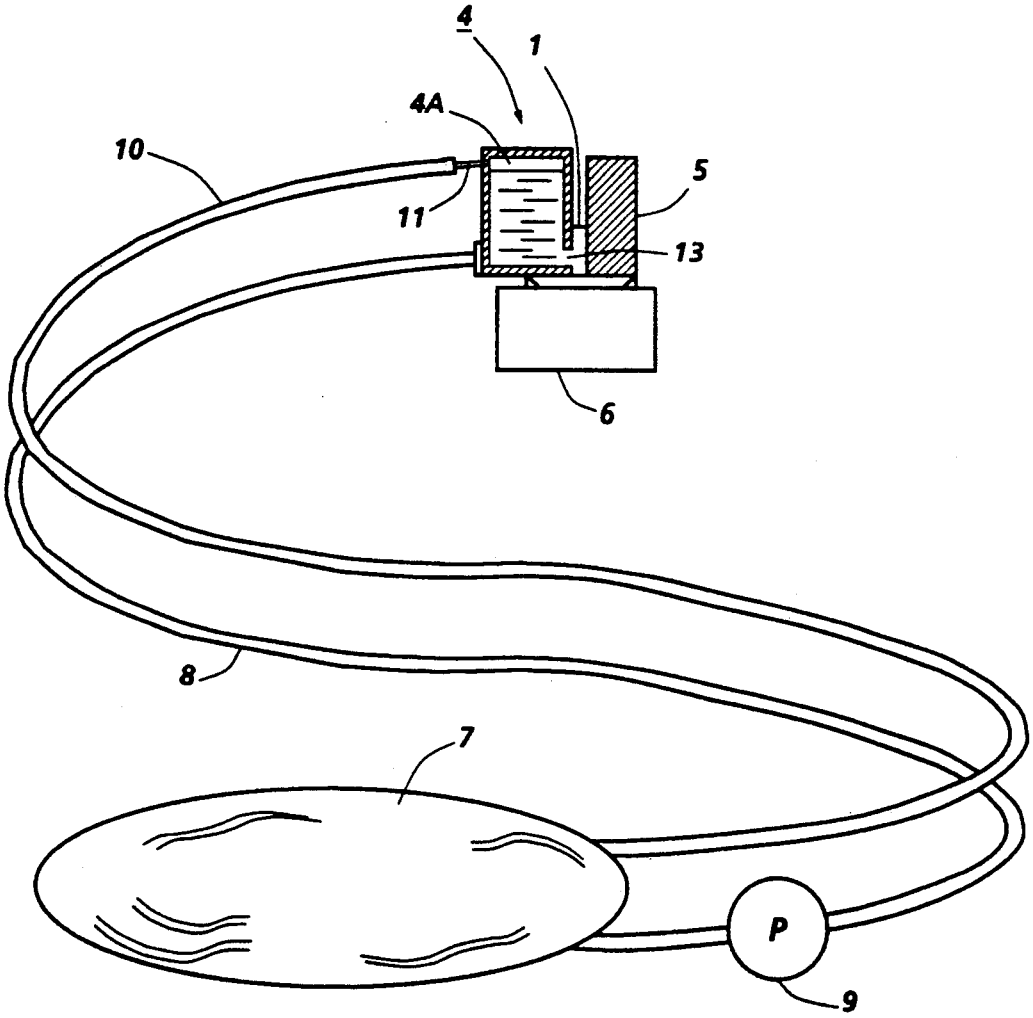
FIG. 2 is a schematic diagram of a printhead assembly of a thermal ink jet printer, including the associated ink supply system.

FIG. 2 shows a schematic diagram of the printhead assembly, comprising a printhead 1 and its on-board reservoir 4, in greater detail. As viewed in this Figure, ink droplets are ejected from the printhead 1 in the downwards direction rather than the horizontal direction as in FIG. 1 for ease in explaining the invention and showing the air pocket 4A above the ink in the ink reservoir 4. Mounted on the side of the printhead remote from the reservoir 4 is a heat sink 5 (not shown in FIG. 1) which carries heat generated by the channel resistors away from the printhead. Both the ink reservoir 4 and the heat sink 5 are mounted on the carriage 2 for movement with the printhead 1.

When the printer is shut down or is idle for an extended period, the printhead 1 is parked at a capping station (not shown) at one side of the printer and a capping device 6 (shown in FIG. 2 but not in FIG. 1) is moved against the printhead to close-off the discharge orifices and prevent the ink in the printhead from drying out. This is the situation illustrated in FIG. 2. If the printhead requires cleaning, either before printing is commenced or during a printing operation, the cleaning is accomplished at the capping station or while it is entering or leaving it.

Ink is supplied to the reservoir 4 of the printhead from a remote stationary reservoir 7 in the form of an ink-containing bag which is removably-mounted in the printer. The bag 7 is connected to the lower part of the reservoir 4 by a supply line 8 which includes a pump 9, and to the upper part of the reservoir by a return line 10 which, at the point of connection to the reservoir, includes a flow restrictor 11 (shown in FIG. 2). The restrictor 11 is selected (for a reason which is explained below) to provide a restriction or flow impedance to ink flow that is equal to, or greater than, that of the printhead 1. When printing is in progress, the pump 9 is not operated and does not impede the flow of ink from the ink bag to the reservoir 4. Thus, when the pump is not operated, it is not a contributor to the flow impedance. Ink expelled from the printhead channels is replaced by ink drawn by capillary action into the channels from the reservoir 4 and, in turn, ink is drawn into the reservoir from the ink bag 7. Any air that may separate out of the ink in the reservoir 4 collects at the top 4A of the reservoir, above the ink, so that the amount of ink within the reservoir will tend to decrease over a period of time. The air readily moves through the restrictor 11, but provides impedance to the flow of ink.

Periodically, it is necessary to prime the system to ensure that the reservoir 4 and also the printhead channels contain sufficient ink. For satisfactory operation, the on-board reservoir 4 should contain as much ink as possible so that the surface level of the ink is well above the air-tight passageway 13 from the reservoir to the printhead. In that way, it can be ensured that air will not enter the printhead from the on-board reservoir 4 during printing despite any movement of the ink that may occur due to movement of the carriage. In addition, because air tends to separate out from the ink in the reservoir 4, the presence of as large a volume of ink as possible allows the greatest amount of air to separate out before a failure in the ink supply occurs. Accordingly, while it would be possible to draw some ink into the printhead assembly simply by applying suction to the capping device 6, that would not result in the assembly being satisfactorily primed because the on-board reservoir 4 would fill with ink only to the height of the ink outlet or passageway 13 from the reservoir to the printhead. Instead, the system shown in the drawing is primed by engaging and operating the pump 9 in the supply line 8 while the printhead 1 is parked at the capping station.

Another advantage of this priming method and apparatus is that the printhead assembly, remote ink supplying reservoir and pump may be arranged into a single customer replaceable unit and the printhead may be primed prior to installation in the thermal ink jet printer 1. An additional advantage is that the present invention enables the priming of the printhead without the need of a vacuum system.

As the pump 9 is operated, ink is forced along the supply line 8 and into the on-board reservoir 4. Although the return line 10 with restrictor 11 presents a restriction to ink flow that is at least as great as that presented by the printhead 1, it offers a comparatively low restriction to air flow. As a result, the flow of ink into the reservoir will result in air being forced out of the reservoir 4 through the return line 10 until the level of ink in the reservoir reaches the return line. So far, very little ink will have entered the printhead 1 because the return line 10 presents a lower resistance to air flow than the printhead presents to ink flow, so that the printhead remains unprimed. Once ink enters the return line, however, the flow restriction presented by the return line 10 is at least as great as that presented by the printhead 1 and ink will flow from the reservoir 4 into both the return and the printhead in amounts determined by the relative values of the restrictions. For example, if the restriction to ink flow presently by the return line 10 is comparable to that presented by the printhead, ink will flow substantially equally through both. At this stage, therefore, the printhead is also primed. The operation of the pump 9 is then terminated and the ink may flow freely throughout.

Typically, a pressure of 40" $H_2O$ is required to prime the printhead 1, so the restrictor 11 and return line 10 are required to provide ink flow impedance of that order or greater. It will be appreciated that, instead of providing a specific restriction 11 at the inlet to the return line 10 as shown in FIG. 2, the internal diameter of the return line could be selected so that the line itself presents the required resistance to ink flow. Thus, priming may be accomplished by using a pump, for example, which produces 80" $H_2O$, if the flow impedance of the supply line is about 5" $H_2O$ and the flow impedance of the restrictor, return line is about 35" $H_2O$, and the flow impedance of the printhead is no more than 40" $H_2O$, so that the net pressure generated by the pump is 40" $H_2O$ and is at least equal to the printhead flow impedance or greater. Typically, a return line having an internal diameter of 0.5 mm could be used for a printhead having a plurality of droplet ejecting orifices that provide an ink flow impedance of about 40" HO. The internal diameters of the supply line, return line, and restrictor are readily determined using well known equations for calculating pressure drops through round tubes.

Advantageously, the ink bag 7 contains means (not shown) to prevent the ink in the bag from foaming as air displaced from the on-board reservoir 4 enters the bag from the return line 10. For example, the bag may incorporate baffles or a screen at the ink outlet.

Figure 3:
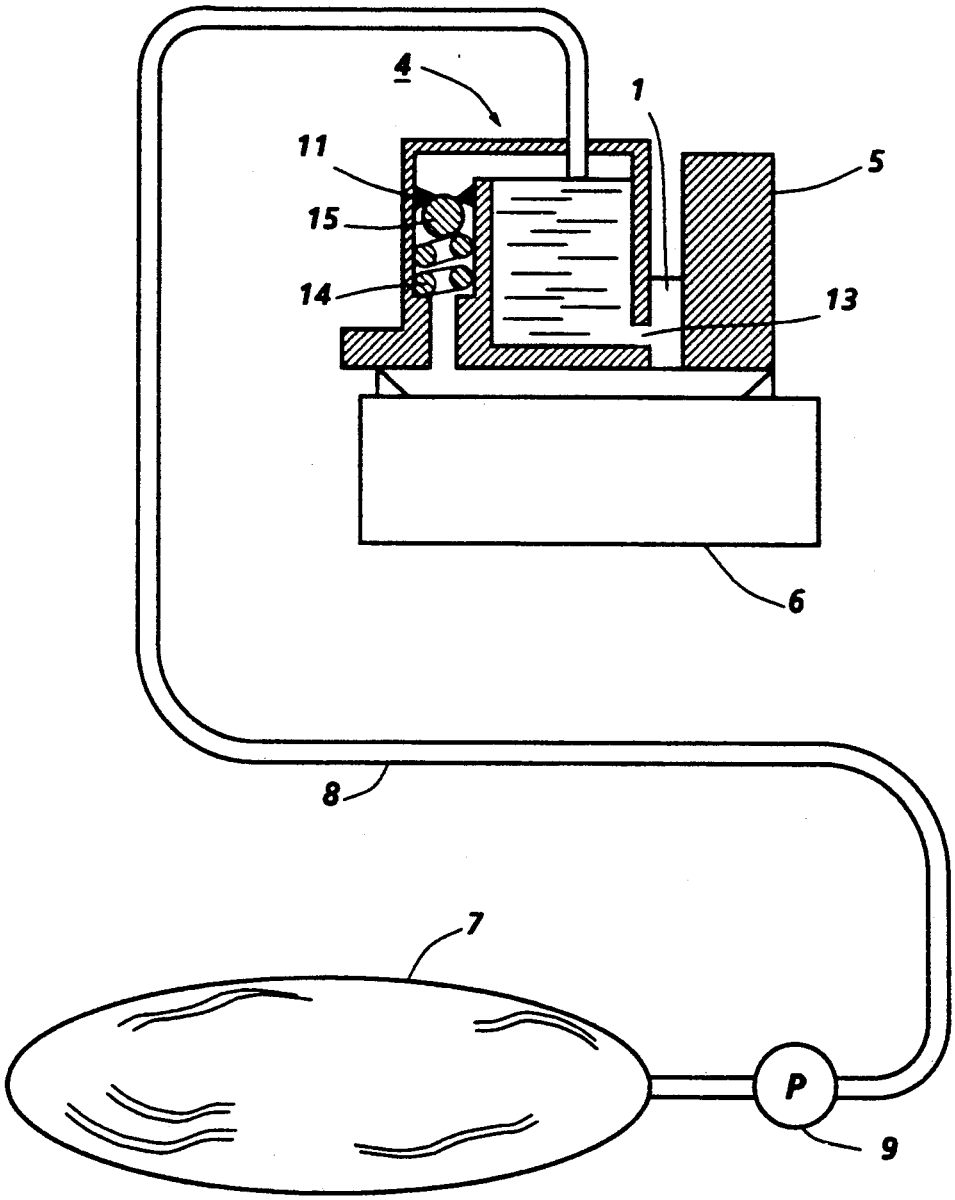
FIG. 3 is a schematic diagram of another printhead assembly.

As an alternative, the return line 10 could be omitted and the reservoir 4 could be provided instead with a vent that incorporates the restriction 11 together with a one-way valve to prevent return flow into the reservoir. An arrangement of that type is shown in FIG. 3, in which the vent is indicated at 14 and the one-way valve at 15. Components that correspond to those in FIG. 2 carry the same reference numerals. As shown in FIG. 3, the vent 14 emerges from the printhead assembly on the same face as that in which the printhead orifices are located and the capping device 6 is extended to cover the vent as well as the printhead orifices. In that way, any ink that flows from the reservoir 4 through the vent 14 during priming will be collected by the capping device 6. In this embodiment, the manifold can be primed either by pressure to the supply line 8 or a vacuum applied by capping device 6.

The pump 9 can be of any suitable type. In one embodiment, for example, the pump may be a manually operated volumetric displacement type with check valves on either side and operated with a finger. Alternatively, instead of connecting a specific pump mechanism in the supply line 8, any arrangement that will force ink along the supply line can be used. For example, a mechanism could be provided to apply pressure to the ink bag 7 to force ink along the supply line 8 and into the reservoir 4.

Although the arrangements described above relate to a printhead assembly in which the on-board reservoir can not be satisfactorily primed by applying suction to the channel orifices of the printhead, a similar arrangement could be utilized to prime other printhead assemblies simply to avoid the need to apply suction to the printhead. The arrangement is not restricted to those printhead assemblies in which ink droplets are ejected from the printhead in a downwards direction as shown in FIGS. 2 and 3, but as shown in FIG. 1, works equally well with printhead assemblies in which the droplets are ejected horizontally.

Also, although the printhead assemblies described above are for a thermal ink jet printer, similar ink supply and priming arrangements could be employed for the printhead assemblies of other forms of drop-on-demand ink jet printers. A similar arrangement could be employed in a printer having a plurality of printheads which need not be mounted on a movable carriage but could, for example, form a fixed array in a so-called "pagewidth" printer. In that case, the printheads are accurately positioned side-by-side to form a pagewidth array which remains stationary while the recording medium is moved in a direction perpendicular to the length of the array.

We claim:

1. A printhead assembly for a drop-on-demand ink jet printer, comprising:

an ink reservoir having an outlet for excess ink;

a printhead being mounted adjacent the ink reservoir and having at least one ink channel that communicates with the reservoir at a location below the reservoir outlet, said at least one ink channel providing a restriction to ink flow and having an ink ejecting orifice at one end of the channel and means operable to cause droplets of ink to be expelled from the orifice for depositing on a recording medium, whereupon the channel is replenished with ink drawn in from the reservoir by capillary action;

an ink supply source;

an ink supply line from the source to said ink reservoir through which ink is, in turn, drawn into the reservoir from the ink source when ink droplets are expelled from the channel orifice and the channel is replenished from the reservoir;

means for delivering ink along the supply line from the source to the ink reservoir when the printhead is not expelling ink droplets, the means for delivering ink being used only to prime the printhead assembly; and said reservoir outlet presenting a restriction to ink flow equal to, or greater than the restriction to ink flow presented by the printhead, the outlet restriction presenting a low restriction to air flow, whereby ink delivered to the ink reservoir by said ink delivering means, to prime the printhead assembly, forces air out of the ink reservoir through said reservoir outlet, so that ink is not forced into the printhead and through the channel orifice until the ink level in the ink reservoir reaches said reservoir outlet.

2. An assembly as claimed in claim 1, including an ink return line from the said outlet to the ink source.

3. An assembly as claimed in claim 2, in which the said restriction is the flow resistance of the return line.

4. An assembly as claimed in claim 1, in which the said outlet comprises a vent from the reservoir and incorporates a valve operable to prevent return flow through the vent into the reservoir.

5. An assembly as claimed in claim 1, in which the means for delivering ink along the supply line comprises a selectively operable pump means connected in the supply line which does not impede the flow of ink from the ink source to the ink reservoir when the pump is not being used to prime the printhead assembly.

6. An assembly as claimed in claim 1, in which at least a portion of the supply line is compressible, and the means for delivering ink along the supply line is operable to compress the said portion of the supply line.

7. An assembly as claimed in claim 1, in which the said ink source comprises a compressible ink container, and the means for delivering ink along the supply line is operable to compress the ink container.

8. An assembly as claimed in claim 2, in which the ink reservoir and printhead are mounted on a scanning carriage of a reciprocating carriage type ink jet printer; and in which the ink supply line and ink return line are adapted to permit relative reciprocal movement between the ink reservoir and the ink source, while the ink reservoir and printhead are reciprocated across a recording medium during a printing operation.

9. An assembly as claimed in claim 8, in which there are a plurality of ink channels in the printhead, each channel being arranged to convey ink from the ink reservoir to a respective ink ejecting orifice located at one end of the channel.

10. A method of priming a printhead assembly for a drop-on-demand ink jet printer comprising an ink reservoir connected to a printhead having ink channels communicating with droplet ejecting orifices, which have a predetermined ink flow impedance, the method comprising the steps of:

(a) providing a conduit from a flexible ink supply container to the ink reservoir for movement of ink therethrough;

(b) providing an outlet in an upper portion of the ink reservoir for unrestricted flow of air therethrough;

(c) connecting the ink reservoir to the channels of the printhead with a sealed passageway located in a lower portion of ink reservoir, so that the sealed passageway is below the ink reservoir outlet;

(d) moving ink from the supply container through the conduit into the ink reservoir by capillary action during printing and under pressure during priming of the printhead assembly;

(e) restricting the flow of ink from the outlet of the printhead reservoir by a flow impedance of ink through the reservoir outlet that is equal or greater than the flow impedance of ink exiting through the printhead orifices;

(f) expelling air from the reservoir through the outlet and concurrently filling the reservoir with ink by the movement of ink into the reservoir from the supply container through the conduit, thereby priming the printhead assembly because ink will not flow from the printhead nozzles until the air has been removed from reservoir and replaced with ink; and (g) collecting ink exiting from the outlet of the reservoir and from the printhead orifices during the priming of the printhead.

11. The method of claim 10, wherein the movement of ink from the supply container to the reservoir under pressure is accomplished by a pump which does not impede the flow of ink when not being used; wherein the collection of ink from the outlet of the printhead reservoir is accomplished by a second conduit having a predetermined internal diameter and connected at one end to the reservoir outlet and connected at the other end to the supply container; and wherein the second conduit provides a predetermined flow impedance to ink but substantially no flow impedance to air.

12. The method of claim 11, wherein the second conduit has a restrictor having a predetermined smaller internal diameter located at the interconnection of the second conduit to the outlet of the printhead reservoir.

13. The method of claim 12, wherein the restrictor provides the majority of the flow impedance of the ink returning to the supply container.

14. The method of claim 10, wherein the restriction of the flow of ink from the outlet of the printhead reservoir is accomplished by a vent having a check valve.

15. The method of claim 14, wherein the printhead has a face containing the droplet ejecting orifices; and wherein the vent discharges through an opening in the face of the printhead.

16. The method of claim 15, wherein the method further comprises: (h) capping the printhead face with an air tight capping device after step (c); and wherein said capping device is used to collect the ink exiting from the vent and orifices.

17. The method of claim 16, wherein the movement of the ink from the supply container to the reservoir is accomplished by a pump which does not impede the flow of ink when not being used.

18. The method of claim 16, wherein the movement of the ink from the supply container to the reservoir is accomplished by providing a suction on the printhead face containing the vent discharge and orifices by a vacuum system to suck ink from said vent discharge and orifices.

* * * * *